US008584902B2

(12) United States Patent
Dejonge

(10) Patent No.: US 8,584,902 B2
(45) Date of Patent: Nov. 19, 2013

(54) CHILD RESISTANT CAP WITH U-CHANNEL COMPONENT

(76) Inventor: Stuart W. Dejonge, Deland, FL (US)

( * ) Notice: Subject to any disclaimer, the term of this patent is extended or adjusted under 35 U.S.C. 154(b) by 148 days.

(21) Appl. No.: 13/385,446

(22) Filed: Feb. 21, 2012

(65) Prior Publication Data

US 2013/0214004 A1 Aug. 22, 2013

(51) Int. Cl.
*B67B 1/00* (2006.01)

(52) U.S. Cl.
USPC ..... 222/153.1; 215/214

(58) Field of Classification Search
USPC ..... 222/153.01, 153.1, 153.09; 215/214, 215/217, 206, 208, 218, 223, 224, 228, 230
See application file for complete search history.

(56) References Cited

U.S. PATENT DOCUMENTS

| | | | | |
|---|---|---|---|---|
| 3,212,662 | A * | 10/1965 | Webb | 215/208 |
| 3,451,576 | A * | 6/1969 | Lewis | 215/222 |
| 3,809,271 | A | 5/1974 | Stroud | |
| 3,822,805 | A | 7/1974 | Marchant | |
| 3,857,507 | A | 12/1974 | Lecinski, Jr. | |
| 3,870,182 | A | 3/1975 | Georgi | |
| 3,895,731 | A | 7/1975 | Coursaut | |
| 3,927,783 | A | 12/1975 | Bogert | |
| 4,006,836 | A | 2/1977 | Micallef | |
| 4,991,729 | A | 2/1991 | Hunter | |
| 5,148,931 | A | 9/1992 | Minh | |
| 5,217,130 | A | 6/1993 | Weinstein | |
| 5,228,583 | A | 7/1993 | Weinstein | |
| 5,317,796 | A | 6/1994 | Hunter | |
| 5,433,329 | A | 7/1995 | Weinstein | |
| 5,915,599 | A * | 6/1999 | Takahashi | 222/402.13 |
| 6,082,565 | A | 7/2000 | Harrold | |
| D537,714 | S * | 3/2007 | Yerby et al. | D9/448 |
| 8,511,491 | B2 * | 8/2013 | House et al. | 215/208 |

* cited by examiner

*Primary Examiner* — Lien Ngo
(74) *Attorney, Agent, or Firm* — Kenneth B. Glynn, Esq; Deirdra M. Meagher, Esq.

(57) ABSTRACT

A child resistant cap with a U-channel safety component includes an inner and an outer member. The inner member has sidewalls with two horizontal tracks, being an upper and a lower track. There in a top horizontal flange with breaks to permit movement of outer member inwardly projecting lugs therethrough, and a central horizontal flange with breaks to permit movement of inwardly projecting lugs from the lower track upwardly past the central horizontal break, past the upper track, and through the breaks of the upper track top horizontal flange. There are vertical stops that prevent the lugs from entering the break when in the upper track, and one stop adjacent one break on the lower track to permit lugs to enter the break when in the lower track. A user rotates the outer member to a position for movement to the lower track, rotates to a stop, and lists to open.

20 Claims, 13 Drawing Sheets

CHILD RESISTANT CAP WITH U-CHANNEL COMPONENT

BACKGROUND OF INVENTION a. Field of Invention

The invention relates generally to child resistant safety caps that have been developed to utilize intelligence for opening and to inhibit children for acquiring access to container contents. These child resistant caps may be used on any container to which it may be attached, such as containers containing child harmful powdered solids, pills, tablets, liquids, gels, gases or combinations thereof, but may be particularly effective in spray and gel dispensers. The present invention caps utilize dual tracks that have U-channel movement of an outer cap relative to an inner cap to effect opening.

b. Description of Related Art

The following patents are representative of the field pertaining to the present invention:

U.S. Pat. No. 6,082,565 to Harrold describes the present invention is a child resistant cap and dispenser. It includes a dispensing container, a flange located non-rotatably connected on the container neck with one-way ratchets, located thereon, said flange being non-rotatably connected to said container neck; a ring collar, non-removably and rotatably connected to the container neck with one-way ratchets located thereon, in functional and cooperative contact with the flange ratchets to permit rotation of it about the neck in one direction and so as to prevent rotation in the opposite direction. The ring collar has an outer circular wall, with one of (i) at least one keyway track and, (ii) at least one keyway protrusion, located thereon, the other being located on a cap, adapted to fit onto the said ring collar. There is a spring mechanism located on at least one of the necks, the collar and the cap, to bias the cap upwardly away from the dispensing container when the cap is connected to the ring collar.

U.S. Pat. No. 5,433,329 to Weinstein describes a child-resistant cap with independent open and close ratchet sets. It includes an inner cap having a top and side walls and having inside surfaces and outside surfaces and an open bottom, and structure for attachment to a container. It also has a flanged base extending outwardly from its side walls, with the flanged base having one-way ratchet members thereon for engagement with an outer collar for locked rotation of an outer collar with the inner cap in a circular, first direction. It also has ratchets located on the outside surface of the top for engagement with an outer cap for rotation of an outer cap with the inner cap in a circular, second direction opposite from said first direction. There is an outer cap having a top and side walls and an open bottom and having inner surfaces and outer surfaces. It is rotatably attached to the inner cap and has ratchets on its inside surface of its top for engagement with the inner cap. There is also an outer collar rotatably mounted about the inner cap and the outer cap which has ratchets thereon for engagement with the ratchets located on the base flange of the inner cap.

U.S. Pat. No. 5,317,796 to Hunter describes Packaging having a combination lock closure is rendered child resistant in a manner that maintains ease of adult use and economy of manufacture while providing adequate protection of child health. The technique comprises the steps of selecting an appropriate child resistance effectiveness, selecting an appropriate older adult use effectiveness, determining a probability of random opening that correlates with the selected child resistances effectiveness and provides at least the selected older adult use effectiveness, and configuring the combination lock closure to present to the package user said probability of random opening. Configuring the closure may include providing a plurality of tumblers, only one of which is accessible to manual manipulation.

U.S. Pat. No. 5,228,583 to Weinstein describes the present invention involves a child resistant closure for containers with threaded necks. It involves an inner cap and an outer cap which engages with one another by ratchets in order to close but these ratchets do not engage when an attempt is made to open the closure. The inner cap and the outer cap are generally cylindrical and have sides and a top, although the outer cap may have an open top. The inner cap has threads on its inside and is adapted to non-removably receive the outer cap so that the outer cap is rotatably engaged therewith. The outer cap is non-removably but rotatably mounted on an engaged with the inner cap. At least one keyway slot is located either on the outside of the inner cap or the inside of the outer cap and there is at least one keyway protrusion extending toward the keyway slot and located on which ever of the inner cap and outer cap does not contain the slot. There are indexes on each of the caps and when they are aligned, the keyway protrusion and the keyway slot will be aligned. The user will align the indexes or indicia and then lift up so that the protrusion fits into the keyway slot. In this manner, the outer cap engages the inner cap so that they are simultaneously rotated for opening. Upon closure, the protrusion will be pushed or dropped out of the slot and the ratchets will engage for proper closure.

U.S. Pat. No. 5,217,130 to Weinstein describes the present invention involves a child resistant closure for containers with threaded necks. It involves a cylindrical inner and outer caps which engage with one another by ratchets to close the closure. These ratchets do not engage when an attempt is made to open the closure. The inner cap has threads on its inside and is adapted to non-removably receive the outer cap in that the outer cap is rotatably engaged therewith. The outer cap is non-removably but rotatably mounted on and engaged with the inner cap. At least two biased keyway slots are used and each may be located either on the outside of the inner cap or the inside of the outer cap. There are at least two biased keyway protrusions, one corresponding to each slot, and each protrusion extends toward its corresponding keyway slot. Each is located on which ever of the inner cap and outer cap does not contain the corresponding slot. There are indexes on each of the caps and when they are aligned, the keyway protrusions ad their corresponding keyway slots will be aligned. The user will align the indexes or indicia and then lift up so that the protrusions fit into their keyway slots. In this manner, the outer cap engages the inner cap so that they are simultaneously rotated for opening. Upon closure, the protrusion will be pushed or dropped out of the slot and the ratchets will engage for proper closure.

U.S. Pat. No. 5,148,931 to Minh describes this invention provides a new and simple tamper-resistant, safety closure for a container having threaded neck. It requires the user to align the two arrows, then give it an upward lift while turning in the counter-clockwise direction to unscrew it from the container. Features of the invention useful in accomplishing the above objects include an outer cap and an inner cap. The interior surface of the outer cap has a plurality of identical protrusions, called the type A protrusions, and one type B protrusion. The exterior surface of the inner cap has a plurality of identical grooves, called the type A grooves, and one type B groove. If the type B protrusion is lifted into the type B groove, then the two caps inter-lock and turning the outer cap in the counter-clockwise direction would also turn the inner cap in the same direction, resulting in the unscrewing of the closure from the container. On the other hand, if the type B protrusion is lifted into one of the type A grooves, then the outer cap will rotate without unscrewing the inner cap from the container.

U.S. Pat. No. 4,991,729 to Hunter describes a rotatable member is held within a closure cap by a circumferential ridge. Both the closure cap and the rotatable member carry inwardly projecting studs. Ribs on stepped cylindrical surfaces of the container neck are provided with channels that permit axial passage of the studs when properly aligned. Proper alignment is achieved by means of stops on the rotatable member and the closure cap which, when engaged during rotation, align the studs circumferentially with the channels. The rotatable member is provided with a frictional fit on the neck of the container, or the rib thereof, so that as the closure cap is rotated, the rotatable member will stay in position on the container neck until the stops contact one another. When the closure cap is rotated in a predetermined direction to a predetermined point, it will cause the stops to contact such as to properly index the studs on the rotatable member relative to channels in a rib on the container neck. Thereafter, rotating the closure cap in the opposite direction to a point which may be determined by markings on the container and the closure cap will cause the studs on the closure cap to be aligned with the channels in a second rib on the container neck so that the closure cap can be removed from the container.

U.S. Pat. No. 4,006,836 to Micallef describes a safety cap for a container including an outer cover having an end wall and a peripheral skirt depending therefrom with a band mounted in the cover. The band and cover are designed for rotatably fastening and unfastening the cap on a container. The band and cover include lock structure to permit rotation of the band and cover onto the container into the fastened position and to prevent rotation of the band and cover into the unfastened position with respect to the container. Furthermore, release structure is provided on the band and cover and is adapted to be shifted between an inactive position whereupon it does not affect the operation of the locking structure and an active position whereupon it deactivates the locking structure and permits the band and cover to rotate into the unfastened position.

U.S. Pat. No. 3,927,783 to Bogert describes this invention is for a leak-proof protective safety closure for containers which is used to prevent inadvertent opening of the container by children or the like. The invention provides a cap having a top and sidewalls which has a wedge-shaped protrusion on the interior of the cap near the base of the sidewalls. A recessed relatively elongated and sloping track is provided on the neck of the container and the wedge rides in the track. Near the base of the track is a notch or groove which accommodates the wedge to lock the cap into position against inadvertent openings. There are pressure means in the form of a rigid ring below the underside of the top of the cap and a flexible plate which flexes while the wedge on the cap rides in the groove and remains under pressure when the wedge snaps into the notch to provide a leak-proof fit. To open the cap it is depressed against the action of the flexible plate to a point where the wedge comes out of the notch or groove and the cap is turned until it is free of the track.

U.S. Pat. No. 3,895,731 to Coursaut describes a closure for receptacles such as bottles comprises an annular member of plastic material which is forced down over the neck of the receptacle. The annular member possesses an external thread and a flange at its lower end including a protuberance concealed by the flange. The closure further comprises a cap internally threaded to engage on the annular member and having a cut-out in its lower edge which snaps over the protuberance when the cap is screwed home. A destructible tamper-proof seal in the form of a ring fits below the flange to prevent, until removed, deformation of the flange with displacement of the protuberance and consequent withdrawal of the protuberance from the cut-out, permitting unscrewing of the cap from the annular member.

U.S. Pat. No. 3,870,182 to Georgi describes a safety closure for a container having an externally threaded neck. The closure includes an inner member that is internally threaded for application to the neck of the container, and an outer closure member fitted over the inner member and holding the inner member captive therein. The outer member fits loosely over the inner member so that the outer member is normally free for rotation relative to the inner member and is also free for limited telescopic movement over the inner member. Lugs are provided on the inner surface of the outer member, and recesses are formed in the outer surface of the inner member, so that when the outer member is lifted, pressed radially inwardly, and rotated the lugs mesh with the recesses to provide engagement between the inner and outer members so that the inner member can be removed from the container by continued rotation of the outer member. Thus, simultaneous application of lifting, radially inwardly compressive, and rotational forces to the outer member is required in order to remove the closure from the container.

U.S. Pat. No. 3,857,507 to Lecinski, Jr. describes this disclosure relates to a novelty safety closure comprising a fitment and a cap for assembly together and telescopic press application onto a container finish, the cap having means reinforcing a part of the fitment against outward deflection, the fitment having an interior surface reducing in diameter from a leading surface portion thereof toward the opposite end thereof, the leading surface portion in the area of the reinforcing means having a diameter sufficient to permit telescopic assembly of the cap and fitment on an associated container finish with little initial resistance to the relative telescopic movement of the diminishing diameter of the fitment above said surface portion with thereafter increasing resistance to a point of interference which is offset by radial outward deflection of the fitment above said surface portion, and the fitment terminates at the opposite end thereof in means for axially opposing abutment of an associated container finish thereby precluding unauthorized removal of the fitment and/or cap from a container finish. The finish also includes means for axially opposing abutment of the fitment abutment means, and in a preferred embodiment of the invention the finish and fitment abutment means are opposed annular shoulders.

U.S. Pat. No. 3,822,805 to Marchant describes a safety closure for containers having a threaded neck, which closure includes an inner closure adapted to be threadably received on the container neck and an outer or overclosure covering, and normally freely rotatable on, the inner closure. The inner closure is provided with continuous engaging means around the lower portion of its skirt, which means are engageable by means provided on two downwardly projecting flexible tabs provided in the lower portion of the skirt of the overclosure. Application of pressure between the thumb and finger compresses the tabs of the outer closure to engage the inner closure, thereby permitting rotation of the locked inner and outer closures to remove the safety closure from the neck of the container. A second embodiment includes a plurality of integrally formed projections on both the top surface of the inner closure and on the bottom surface of the outer closure. The projections are adapted to engage to rotate the inner closure when the outer closure is rotated to attach the safety closure to the container and to disengage when the outer closure is rotated to detach the safety closure without pressing the tabs to lock the outer closure into engagement with the inner closure.

U.S. Pat. No. 3,809,271 to Stroud describes a safety closure for securement to containers and vials and adapted to prevent access to the contents of said containers and vials, the safety closure including an inner cap and an external lid both frictionally retainable on the open end of the container or vial. The inner cap includes a central plate having a peripheral wall around the outer periphery thereof adapted to frictionally engage the inside wall of the container or vial. A flange secured to the upper edge of the peripheral wall prevents the internal cap from moving downwardly into the container from the upper end thereof. The internal cap includes an interlock structure formed on the peripheral wall. The external cap includes a central plate having an annular flange projecting from the outer periphery of the central wall and dimensioned to frictionally engage the outer wall of the container or vial. The outer wall of the external lid includes an interlock structure adapted to mate with, and engage, the interlock structure of the internal cap to facilitate removal of the internal cap from the container or vial.

Notwithstanding the prior art, the present invention is neither taught nor rendered obvious thereby.

SUMMARY OF INVENTION

The present invention is directed a child resistant cap with a U-channel safety component which comprises: a) an inner member having a top and sidewalls and an open bottom, the sidewalls having two horizontal tracks, a first of the two horizontal tracks being an upper track, and a second of the horizontal tracks being a lower track, the upper track having a top horizontal flange with at least one break to permit movement of an outer member inwardly projecting lug therethrough, the upper track and the lower track being separated by a central horizontal flange with at least one break to permit movement of an outer member inwardly projecting lug from the lower track upwardly past the central horizontal break, past the upper track, and through the at least one break of the upper track top horizontal flange, the upper track having two vertical stops for one break of the at least one break of the upper track, the two vertical stops being one left of the break and one right of the break to prevent an outer member inwardly projecting lug from entering the break when in the upper track, the lower track having one stop adjacent one break, the at least one break of the lower track to permit an outer member inwardly projecting lug to enter the break when in the lower track; b) an outer member, being a cover member, the outer member having a closed top and sidewalls and an open bottom, the sidewalls having a top view footprint so as to fit over the sidewalls of the inner member, and having at least one inwardly projecting lug adapted to snap over the top horizontal flange and subsequently snap over the central horizontal flange; wherein the outer member is initially placed over the top horizontal flange and into the upper track of the inner member so that the at least one inwardly projecting lug is positioned in the upper track; and, wherein a subsequent user must first press down on the outer member to force the at least one inwardly projecting lug over the rental projecting flange and into the lower track of the inner member, and next horizontally rotate the upper member relative to the lower member until one of the at least one inwardly projecting lug is aligned with the upper track and lower track breaks, and next left the outer member so as to move the at least one inwardly projecting lug through the breaks to remove the upper member from the lower member.

In some embodiments of the present invention child resistant cap with a U-channel safety component, there are four lower track breaks, four upper track breaks and four inwardly projecting lugs.

In some embodiments of the present invention child resistant cap with a U-channel safety component, each of the four lower track breaks and the four upper track breaks and the four inwardly projecting lugs are symmetrically arranged and evenly spaced from one another.

In some embodiments of the present invention child resistant cap with a U-channel safety component, each of the four lower track breaks and the four upper track breaks and the four inwardly projecting lugs are asymmetrically arranged and unevenly spaced from one another.

In some embodiments of the present invention child resistant cap with a U-channel safety component, the at least one inwardly projecting lug is a downwardly tapered ratchet.

In some embodiments of the present invention child resistant cap with a U-channel safety component, the top horizontal flange and the central horizontal flange are downwardly yielding snap beads.

In some embodiments of the present invention child resistant cap with a U-channel safety component, the inner member includes attachment means for permanent connection to a container having a rim.

In some embodiments of the present invention child resistant cap with a U-channel safety component, it further includes a container with a rim and with the inner member permanently attached thereto.

In some embodiments of the present invention child resistant cap with a U-channel safety component, the container is a spray container and the inner member has an orifice on its top for protrusion of a spray nozzle therethrough.

In some embodiments of the present invention child resistant cap with a U-channel safety component, the container includes a tilt dispensing nozzle and the inner member includes a tiltable shaft adapted to fit onto the tilt dispensing nozzle.

In some embodiments of the present invention child resistant cap with a U-channel safety component, the central horizontal flange is generally rigid and the at least one lug cannot traverse the central horizontal flange, and the central horizontal flange has at least one thin for each of the at least one lugs at which the at least one lug can traverse the central horizontal flange to move from the upper track to the lower track.

In some embodiments of the present invention child resistant cap with a U-channel safety component, the outer member and the inner member include indicia for alignment thereof to correspond to alignment of the at least one inwardly projecting lug with the central horizontal flange at least one thin.

In some embodiments of the present invention child resistant cap with a U-channel safety component, there are two lower track breaks and two upper track breaks and two inwardly projecting lugs.

In some embodiments of the present invention child resistant cap with a U-channel safety component, it further includes a container with a rim and with the inner member permanently attached thereto.

In some embodiments of the present invention child resistant cap with a U-channel safety component, the container is a spray container and the inner member has an orifice on its top for protrusion of a spray nuzzle therethrough.

In some embodiments of the present invention child resistant cap with a U-channel safety component, the container includes a tilt dispensing nozzle and the inner member includes a tiltable shaft adapted to fit onto the tilt dispensing nozzle.

In some embodiments of the present invention child resistant cap with a U-channel safety component, the inwardly projecting lugs are identical.

In some embodiments of the present invention child resistant cap with a U-channel safety component, the inwardly projecting lugs are different and have different widths.

In some embodiments of the present invention child resistant cap with a U-channel safety component, the inwardly projecting lugs are identical.

In some embodiments of the present invention child resistant cap with a U-channel safety component, the inwardly projecting lugs are different and have different widths.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings.

DETAILED DESCRIPTION OF THE EMBODIMENTS

Figure 1:
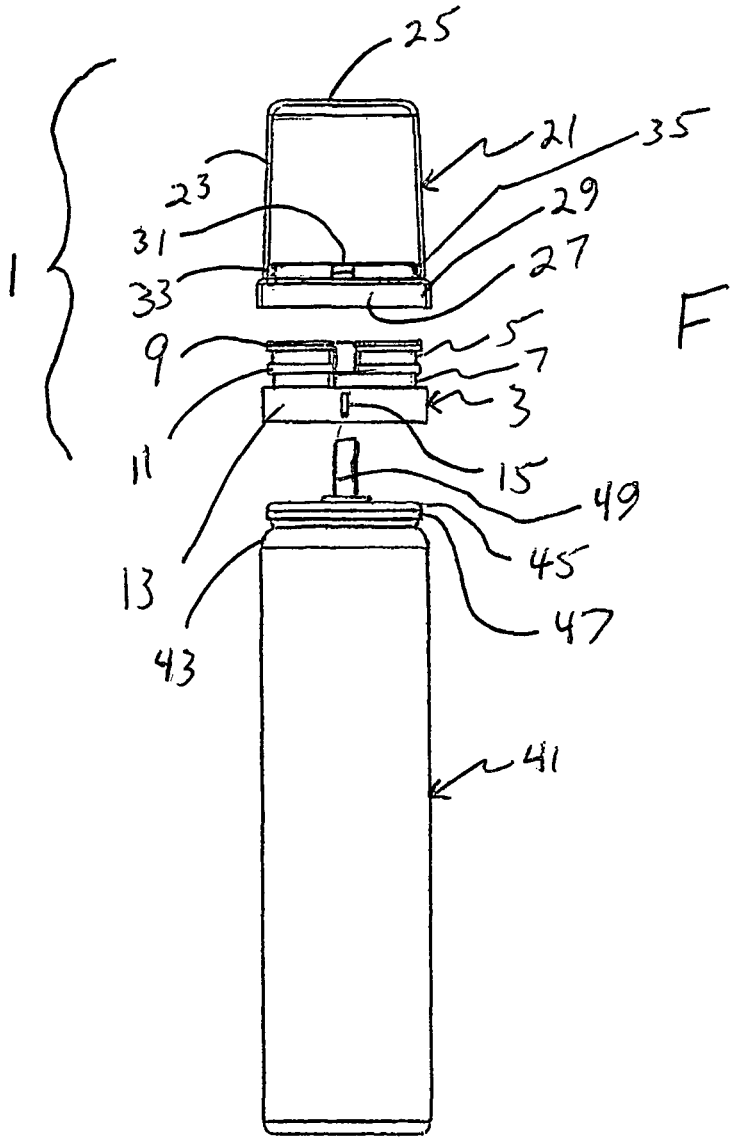
FIG. 1 shows a front partially cut view of one embodiment of a present invention child resistant cap with a U-channel component.

Referring now in detail to the drawings wherein like reference numerals designate corresponding parts throughout the several views, various embodiments of the present invention are shown.

FIG. 1 shows a front partially cut view of one embodiment of a present invention child resistant cap 1. It includes an inner member 3 with a sidewall 13, having a horizontal upper track 5 and a horizontal lower track 7. There is a top horizontal flange 9 above the horizontal upper track 5 and a central horizontal flange 11 between the horizontal upper track 5 and the horizontal lower track 7. These flanges have breaks and stops to allow movement of lugs (discussed in more detail below) through a U-channel type path for removal of an outer member 21 from inner member 3. Inner member 3 has an indicator 15 for alignment to the outer member 21 (cut view, and thus its indicator is not shown) for downward movement of the outer member 21 from the horizontal upper track 5 to the horizontal lower track 7. Inner member 3 also has an open bottom with internal attachment means, such as a one way snap bead, for permanent attachment to container 41's neck 43. Specifically, it will fit over rim 47 and lock onto it. Container top 45 has a dispensing nozzle 49 that could dispense liquid, gas, spray or gel, and inner member 3 has an orifice in its top to fit over dispensing nozzle 49 for use when outer member 21 has been removed from inner member 3.

Outer member 21 has a side wall 23, a top 25 and an open bottom 27 with a base ring that fits over container top 45. Outer member 21 also has an internal set of inwardly directed lugs (four in this embodiment) and three are shown, namely, lugs 31, 33 and 35. These lugs 31, 33 and 35 will travel over horizontal top flange 9 and into horizontal upper track 5 by slipping over horizontal top flange 9 by virtue of flexibility of the flange 9, the lugs 31, 33 and 35, the outer member 21, or combinations thereof. Removal of outer member 21 from inner member 3 is achieved in steps that simulate a U-channel movement and this is described in detail below.

Figure 2:
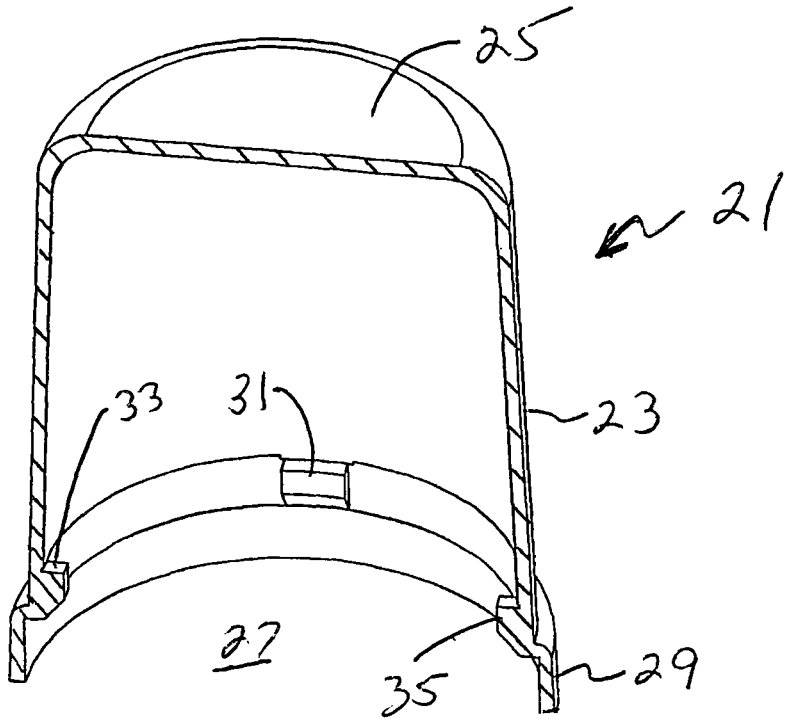
FIG. 2 shows a cut oblique front view of the outer member of the present invention child resistant cap shown in FIG. 1.
Figure 3:
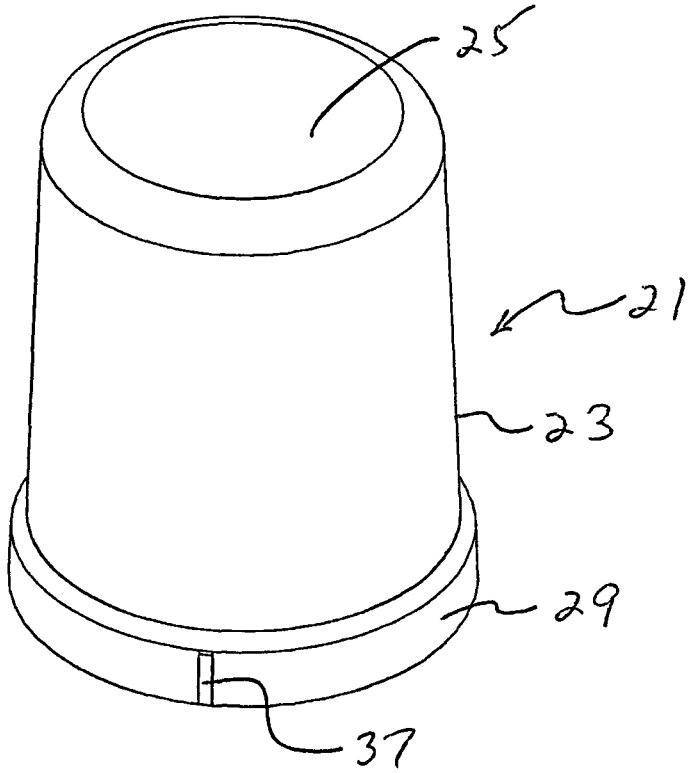
FIG. 3 shows an oblique front view of the outer member of the present invention child resistant cap shown in FIG. 1.

FIG. 2 shows a cut oblique front view of the outer member of the present invention child resistant cap shown in FIG. 1 and FIG. 3 shows an oblique front view of the outer member of the present invention child resistant cap shown in FIG. 1. The elements are identically numbered as above, and now alignment indicator 37 is illustrated in FIG. 3. Also, note that FIG. 2 shows lug details that are optional, but preferred. Here, lugs 31, 33 and 35 are downwardly tapered. This enhances movement of the lugs downwardly over horizontal top flange 9, yet inhibits removal by upward movement over horizontal top flange 9 by mere lifting. This renders the outer member 21 child resistant, as cannot simply be pulled off.

Figure 4:
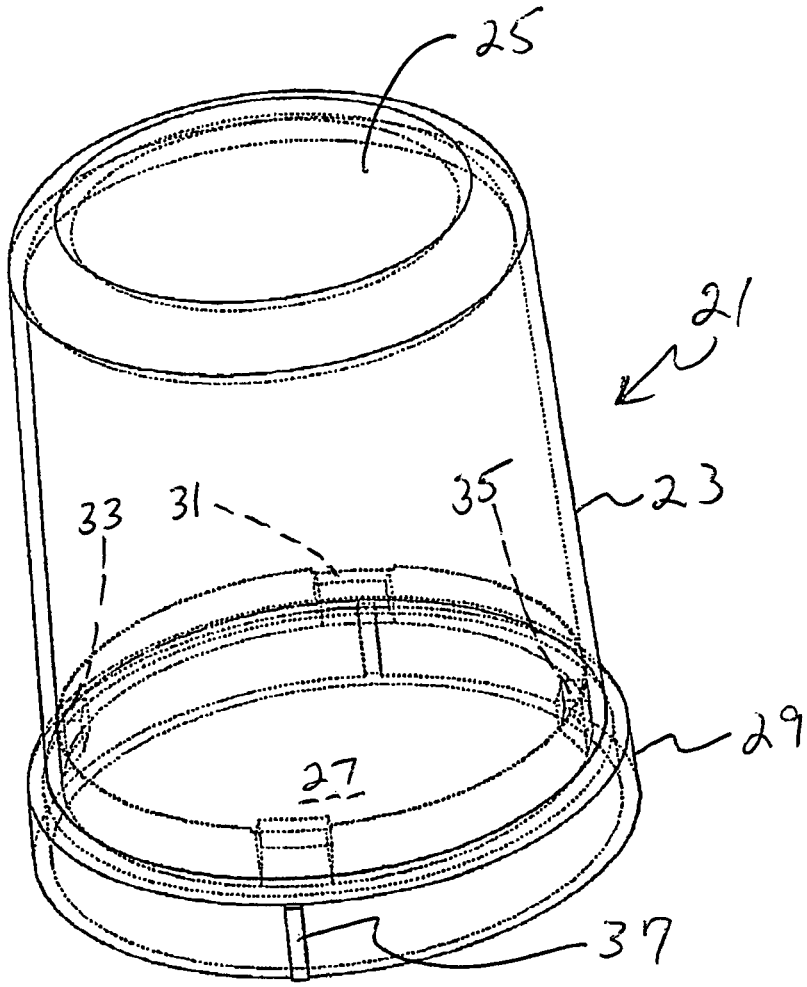
FIG. 4 shows an oblique see through front view of the outer member shown and described above.

FIG. 4 shows an oblique see through front view of the outer member shown and described above, showing all elements described and numbered above in a single view.

Figure 5:
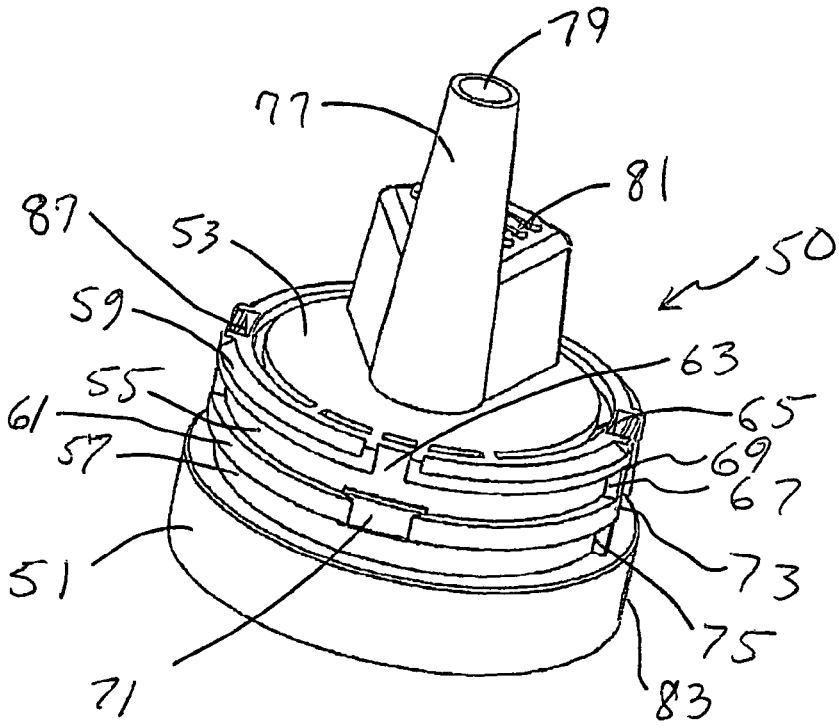
FIG. 5 shows a front oblique view of another embodiment inner member of a present invention child resistant cap with a U-channel component.
Figure 6:
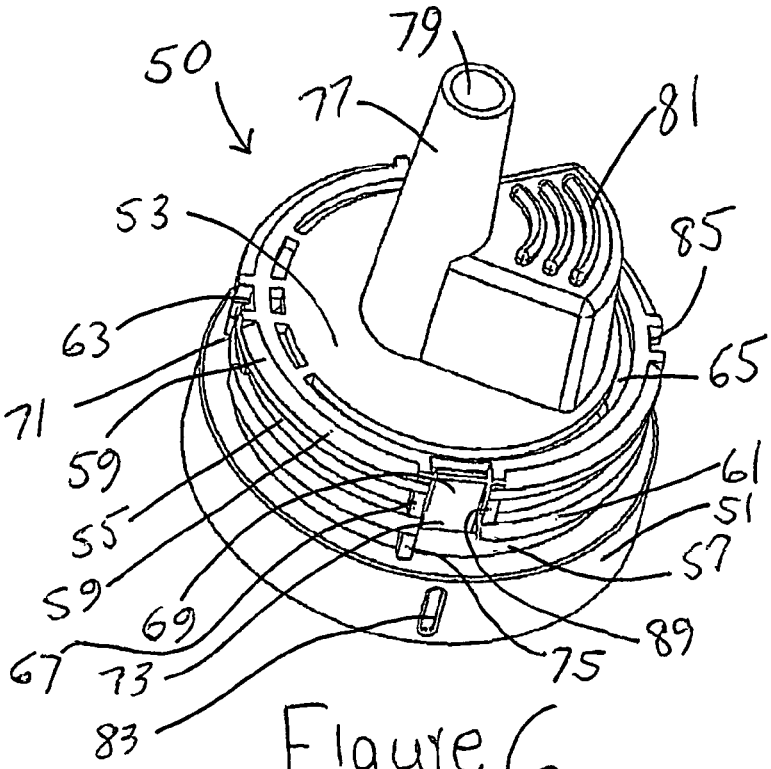
FIG. 6 shows a side view of the inner member of a present invention child resistant cap with a U-channel component shown in FIG. 5.

FIG. 5 shows a front oblique view of another embodiment inner member of a present invention child resistant cap with a U-channel component and FIG. 6 shows a side view of the outer member of a present invention child resistant cap with a U-channel component shown in FIG. 5. Both FIGS. 5 and 6 are discussed here together. Inner member 50 is designed to be attached to a dispenser container such as a hair mousse or other product container. Inner member 50 includes a sidewall 51 and a top 53. Sidewall 51 has a horizontal upper track 55 and a horizontal lower track 57 for movement of outer member lugs (described below). Above horizontal upper track 55 is top horizontal flange 59. Flange 59 may be flexible and/or tapered downwardly so as to permit lugs of an outer member to be pressed onto and over top horizontal flange 59 and into upper track 55. Located between horizontal upper track 55 and horizontal lower track 57 is central horizontal flange 61, which is an inflexible flange with selected position thins for downward movement of lugs only at the thins and not otherwise. (While thins are shown and described, other "gates" could be used without exceeding the scope and intent of the present invention. For example, a one way living hinge for downward movement only could be used in place of the thins. Other alternative equivalents are within the purview of the artisan.)

Breaks (slide slots or openings) are established in both top horizontal flange 59 and central horizontal flange 61. Top horizontal flange 59 has a first break 63 a second break 69 a third break 85 and a forth break 87. These breaks are to permit removal of an outer member with lugs to be removed only in one "firing" position. This is achieved by having vertical stops to the left and right of one of the top horizontal flange breaks. In this case, second break 69 has an upper track left stop 67 and upper track right stop 89. This prevents lugs from entering break 69 when lugs are in horizontal upper track 55. Central horizontal flange 61 has four breaks, two of which are shown in the figure—first central horizontal flange break 71 and second central horizontal flange break 73. When lugs are in the horizontal lower track 57, they are freely movable into the "firing" position and will stop in the break due to a single lower track stop 75.

Once the outer member (cap) is removed, there are built-in dispensing components in inner member 50 in this embodiment. Thus, top 53 includes a tiltable shaft 77 with outlet orifice 79 and tiltable shaft depressor 81. There are arc cut outs such as cut out 65 to make the shaft 77 titlable when depressor 81 is pressed. This will release container content, such as a gel, as desired. The inner member 50 also includes an indicator 82 for alignment with a similar one on an outer member for aligned downward movement of lugs over thins to move from the horizontal upper track 55 to the horizontal lower track 57, for subsequent rotation and firing.

When a present invention child resistant cap inner member is manufactured, it will have an internal snap bead or other attachment means for attaching to the neck or top of a container, typically a prefilled container, or it will be integrally molded into the container neck. The outer member, such as shown above and below, is initially placed over the top horizontal flange and into the upper track of the inner member so that the inwardly projecting lug(s) is positioned in the upper track. A subsequent user must first press down on the outer member to force the at least one inwardly projecting lug over the rental projecting flange and into the lower track of the inner member, and next horizontally rotate the upper member relative to the lower member until one of the at least one inwardly projecting lug is aligned with the upper track and lower track breaks, and next left the outer member so as to move the at least one inwardly projecting lug through the breaks to remove the upper member from the lower member.

Figure 7:
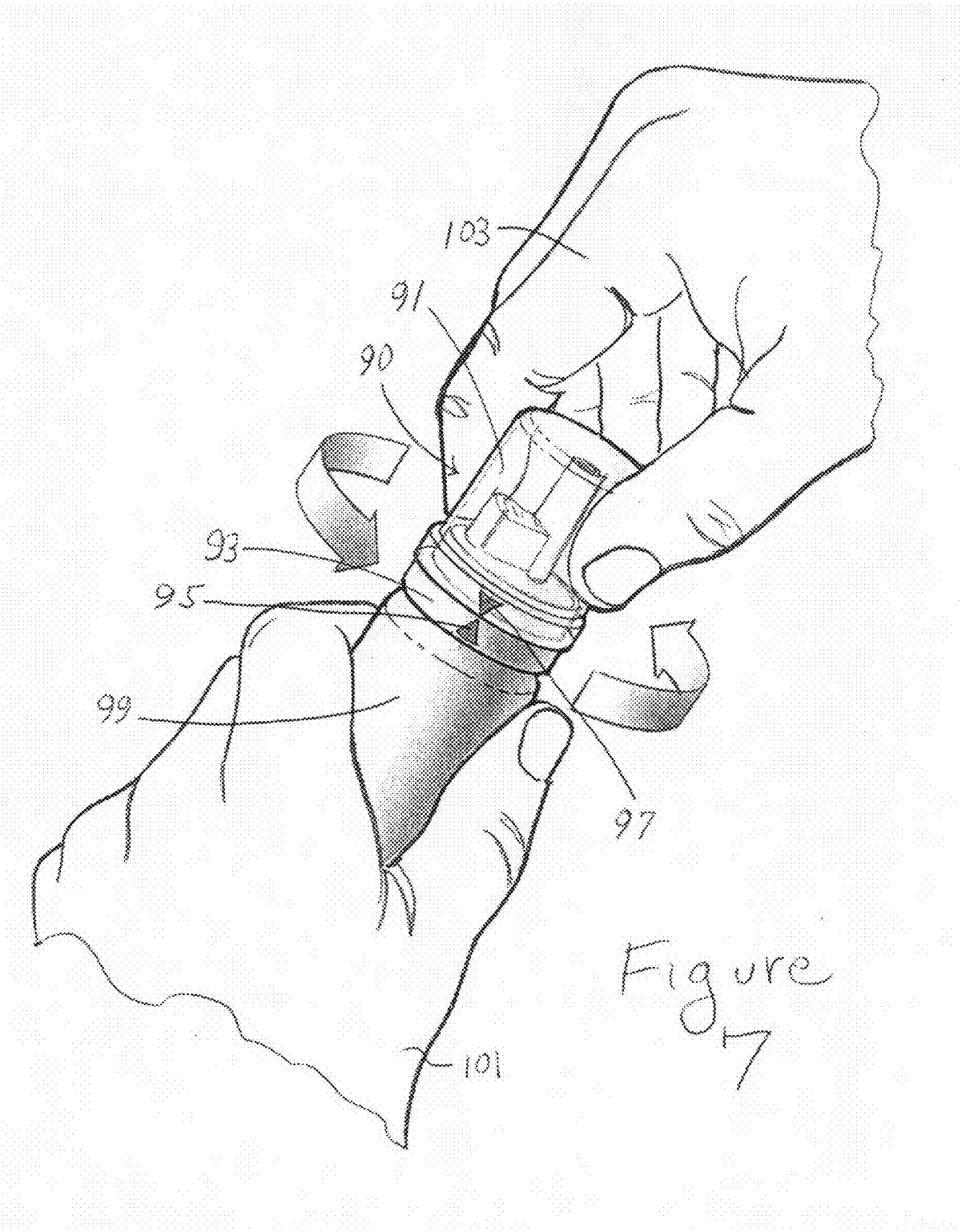
FIG. 7 shows another embodiment of a present invention child resistant cap with U-channel component in its first step of opening (rotating in the outer track for alignment)
Figure 8:
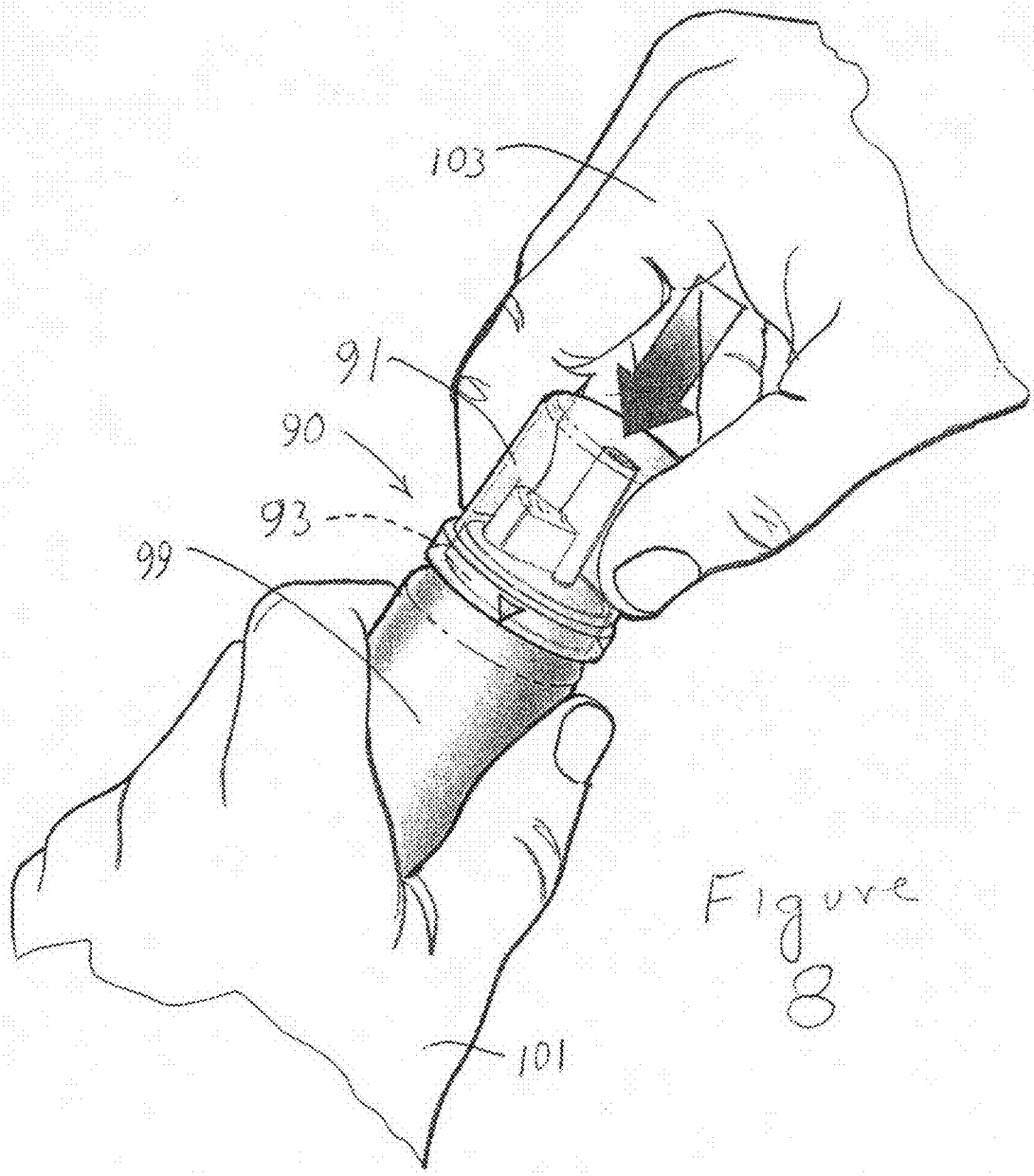
FIG. 8 shows the same present invention child resistant cap with U-channel component in its second step of opening (push down to snap into lower track)
Figure 9:
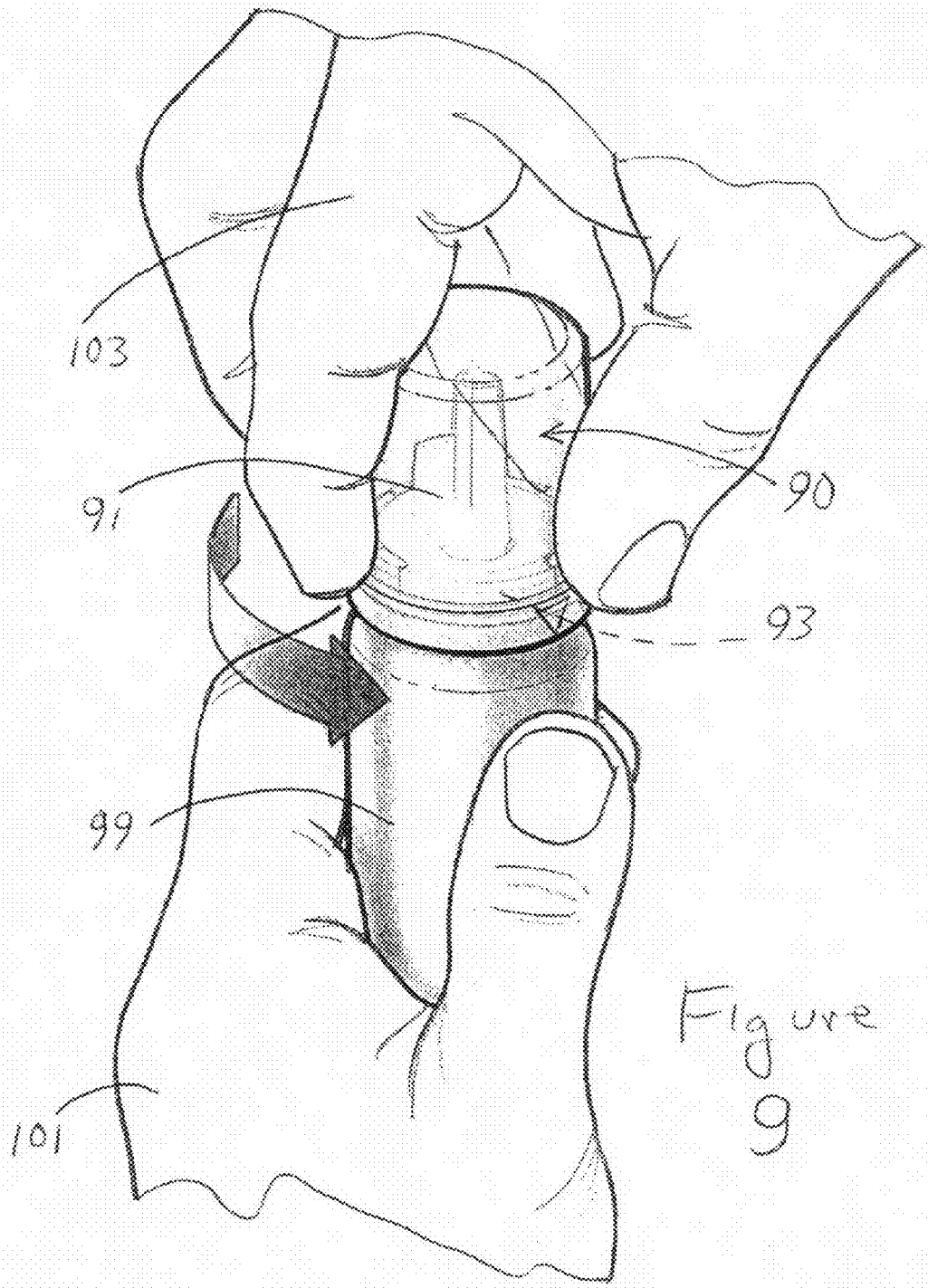
FIG. 9 shows the same present invention child resistant cap with U-channel component in its third step of opening (rotate to break stop)
Figure 10:
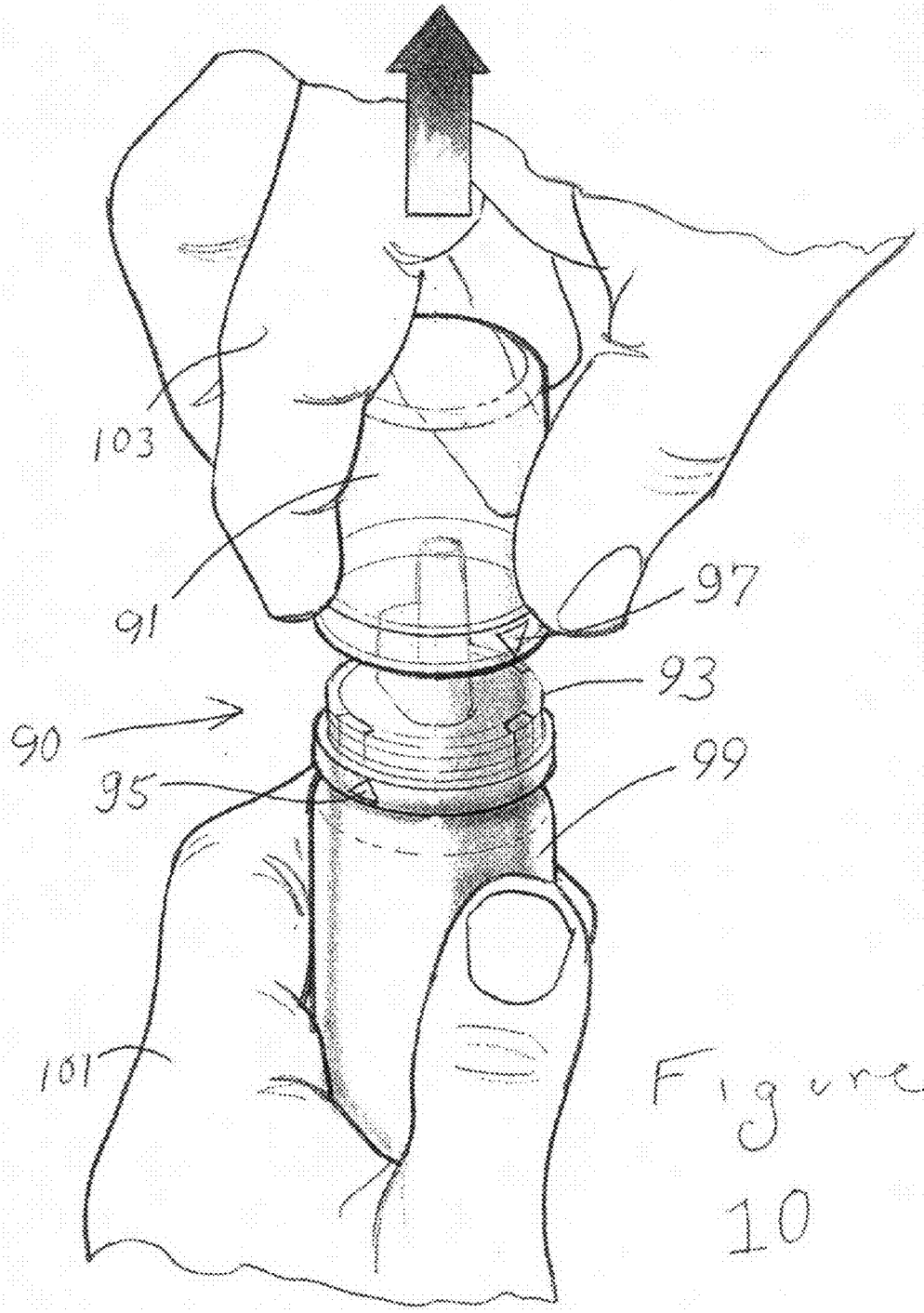
FIG. 10 shows the same present invention child resistant cap with U-channel component in its fourth (final) step of opening (lift through both flange breaks)
Figure 11:
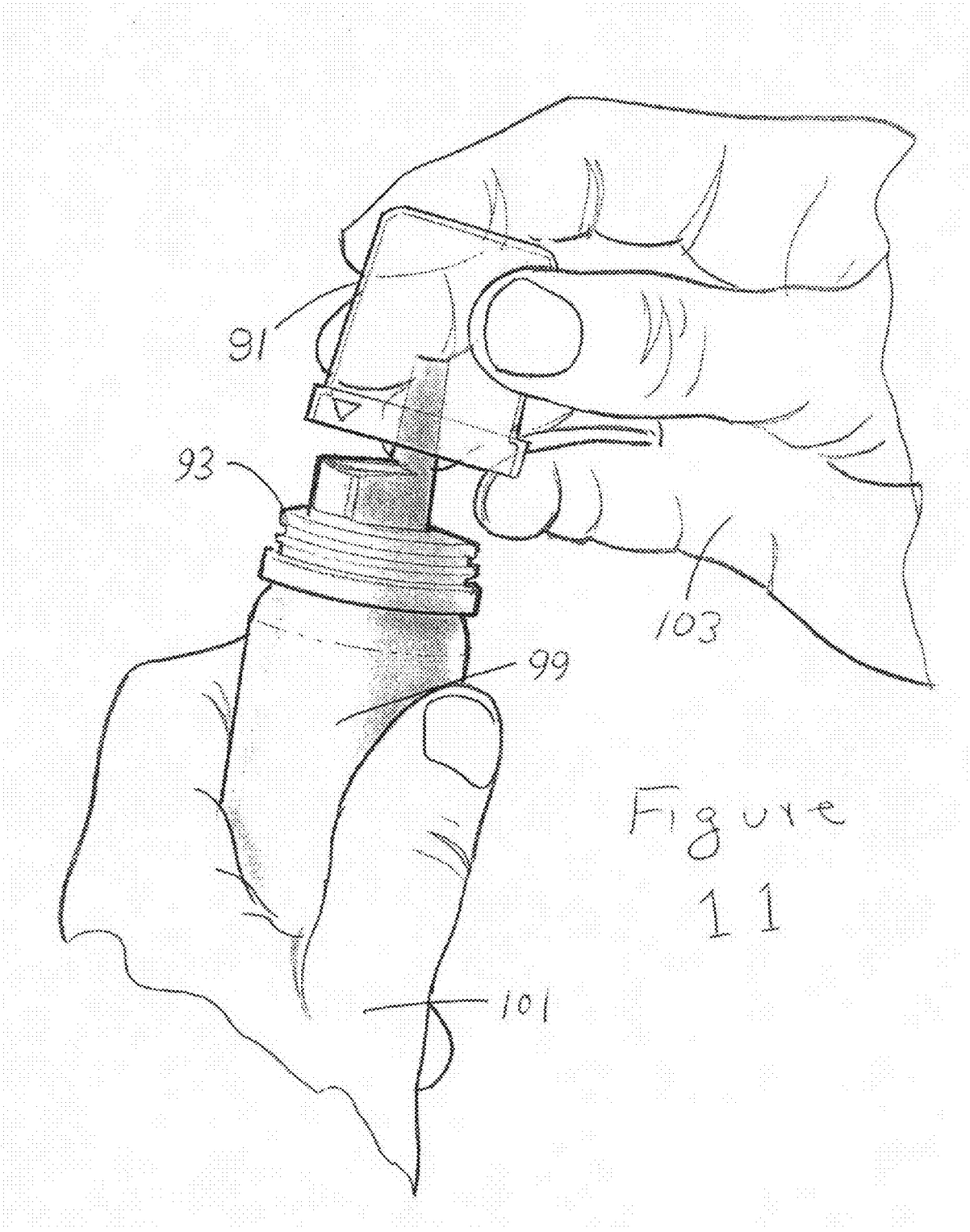
FIG. 11 shows the same present invention child resistant cap with U-channel component with outer member replacement after use.

FIG. 7 shows another embodiment of a present invention child resistant cap 90 in its first step of opening. Here, inner member 93, with a tilt dispenser shaft and actuator, has been permanently and non-rotatably attached to the neck of container 99. Outer member 91 has been snapped onto inner member 93 with its lugs in an upper track. A user holds container 99 with her left hand 101 and rotates outer member 91 with her right hand 103, in whichever direction works, to align outer member alignment indicator 97 with inner member alignment indicator 95. FIG. 8 shows the same present invention child resistant cap 90 in its second step of opening and identical elements are identically numbered. After proper alignment, the user pushes down to move the outer member 91 down and move the lugs of the outer member 91 into the lower horizontal track. FIG. 9 shows the same present invention child resistant cap in its third step of opening and identical elements are identically numbered. After moving the lugs into the lower track, the user rotates the outer member 91 to move the lugs to stop at the lower track single stop and place the lugs into the firing (opening) position. As shown in FIG. 10, the user lifts the outer member 91 completely off the inner member 93 so as to move the lugs from the lower track, through the central flange breaks, through the upper track and through the upper track breaks for opening. The user will then dispense contents as needed and place the outer member 91 onto the lower member 93. FIG. 11 shows this same present invention child resistant cap 90 with outer member 91 replacement after use.

Figure 12:
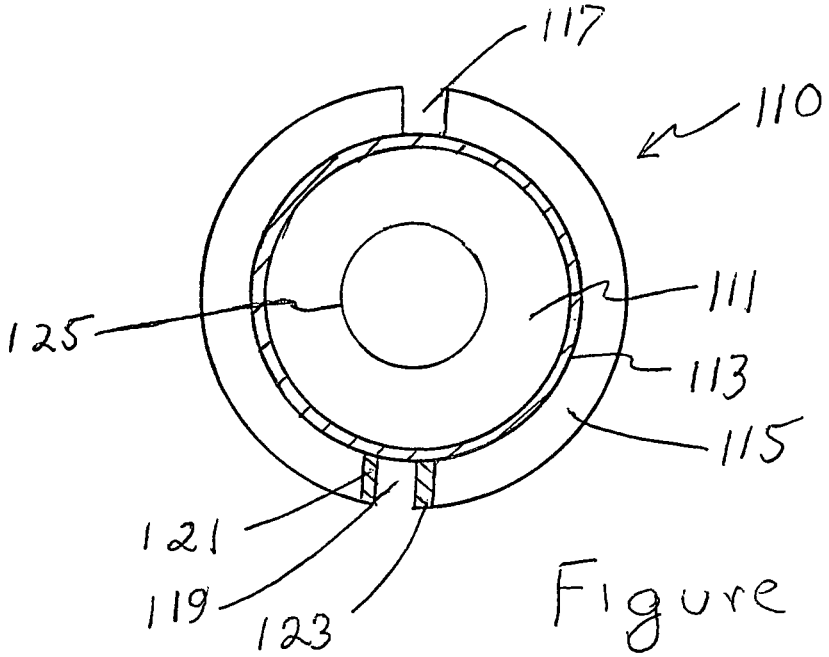
FIG. 12 shows a top view of another embodiment of a present invention child resistant cap with U-channel component inner member with only two breaks on each flange for a two lug outer member, being the same size and symmetric with respect to one another.

FIG. 12 shows a top view of another embodiment of a present invention child resistant cap inner member 110 with side wall 113 and top 111 with dispenser orifice 125. Inner member 110 has only two breaks 117 and 119 on each flange, such as top flange 115, for a two lug outer member, being the same size and symmetric with respect to one another. There are left and right stops 121 and 123 in its upper track and a single stop (not shown because it is below left stop 121) in its lower track. In this embodiment, the breaks are symmetric and of equal size and spacing.

Figure 13:
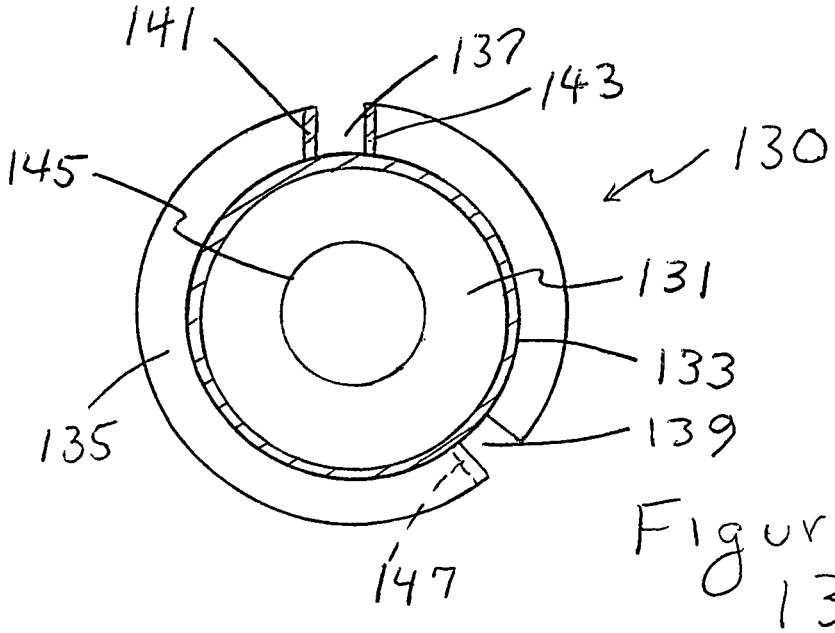
FIG. 13 shows a top view of another embodiment of a present invention child resistant cap with U-channel component inner member with only two breaks on each flange for a two lug outer member, being the same size and asymmetric with respect to one another.

FIG. 13 shows a top view of another embodiment of a present invention child resistant cap inner member 130 with side wall 133 and top 131 with dispenser orifice 145. Inner member 130 has only two breaks 137 and 139 on each flange, such as top flange 135, for a two lug outer member, being the same size and similarly positioned with respect to one another as are the breaks. There are left and right stops 141 and 143 in its upper track and a single stop 147 in its lower track. In this embodiment, the breaks are asymmetric and of unequal size and spacing.

Figure 14:
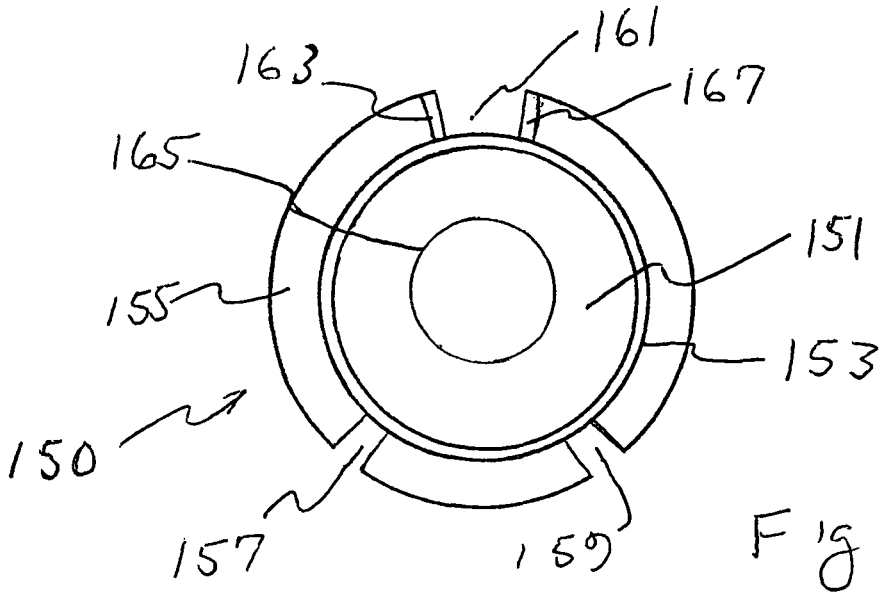
FIG. 14 shows a top view of another embodiment of a present invention child resistant cap with U-channel component inner member with only three breaks on each flange for a two lug outer member, being a different size and asymmetric with respect to one another.

FIG. 14 shows a top view of another embodiment of a present invention child resistant cap inner member 150 with side wall 153 and top 151 with dispenser orifice 165. Inner member 150 has three breaks 157, 159 and 161 on each flange, such as top flange 155, for a three lug outer member, being the same size and similarly positioned with respect to one another as are the breaks. There are left and right stops 163 and 167 in its upper track and a single stop (not shown) in its lower track. In this embodiment, the three breaks are asymmetric and of unequal size and spacing.

Figure 15:
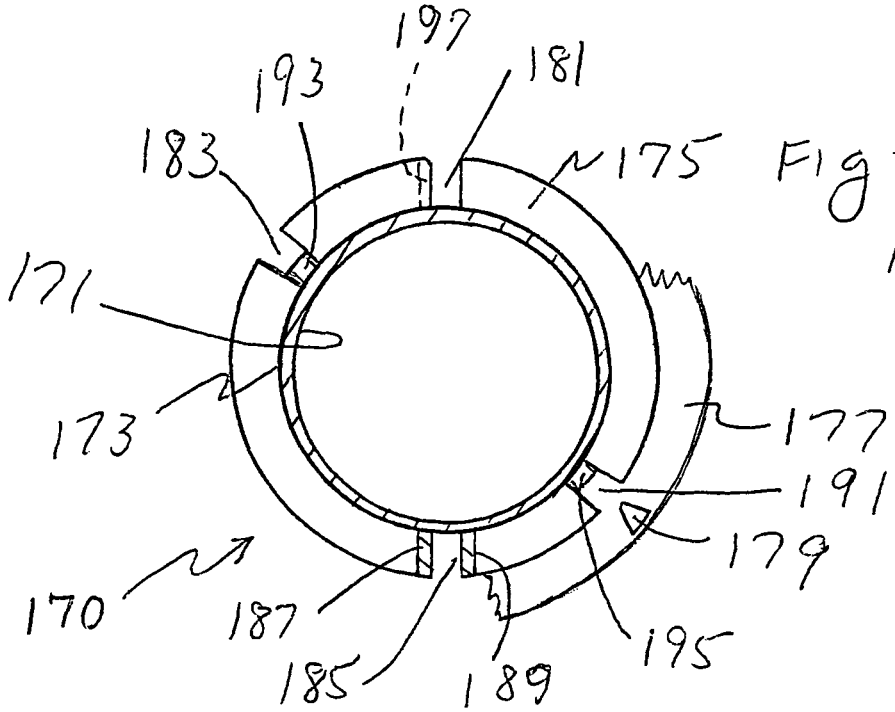
FIG. 15 shows a top view of another embodiment of a present invention child resistant cap with U-channel component inner member with only two breaks on each flange for a two lug outer member, being the same size and symmetric with respect to one another with central horizontal flange thins; and, FIG. 16 shows a front oblique view of another embodiment of a present invention child resistant cap with U-channel component inner member detailing the exit breaks and a preferred one way ratchet ramp on the inner member.

FIG. 15 shows a top view of another embodiment of a present invention child resistant cap inner member 170 with side wall 173 and a cut top 171. Inner member 170 has only two breaks 181 and 185 on each flange, such as central flange 175, for a two lug outer member, being the same size and similarly positioned with respect to one another. There are left and right stops 187 and 189 in its upper track and a single stop 197 in its lower track. In this embodiment, the central flange 175 has thins 193 and 195 that permit lugs to pass down through them via openings 183 and 191 when properly aligned and pressed down, they are then rotated and lifted to open, as discussed above.

Figure 16:
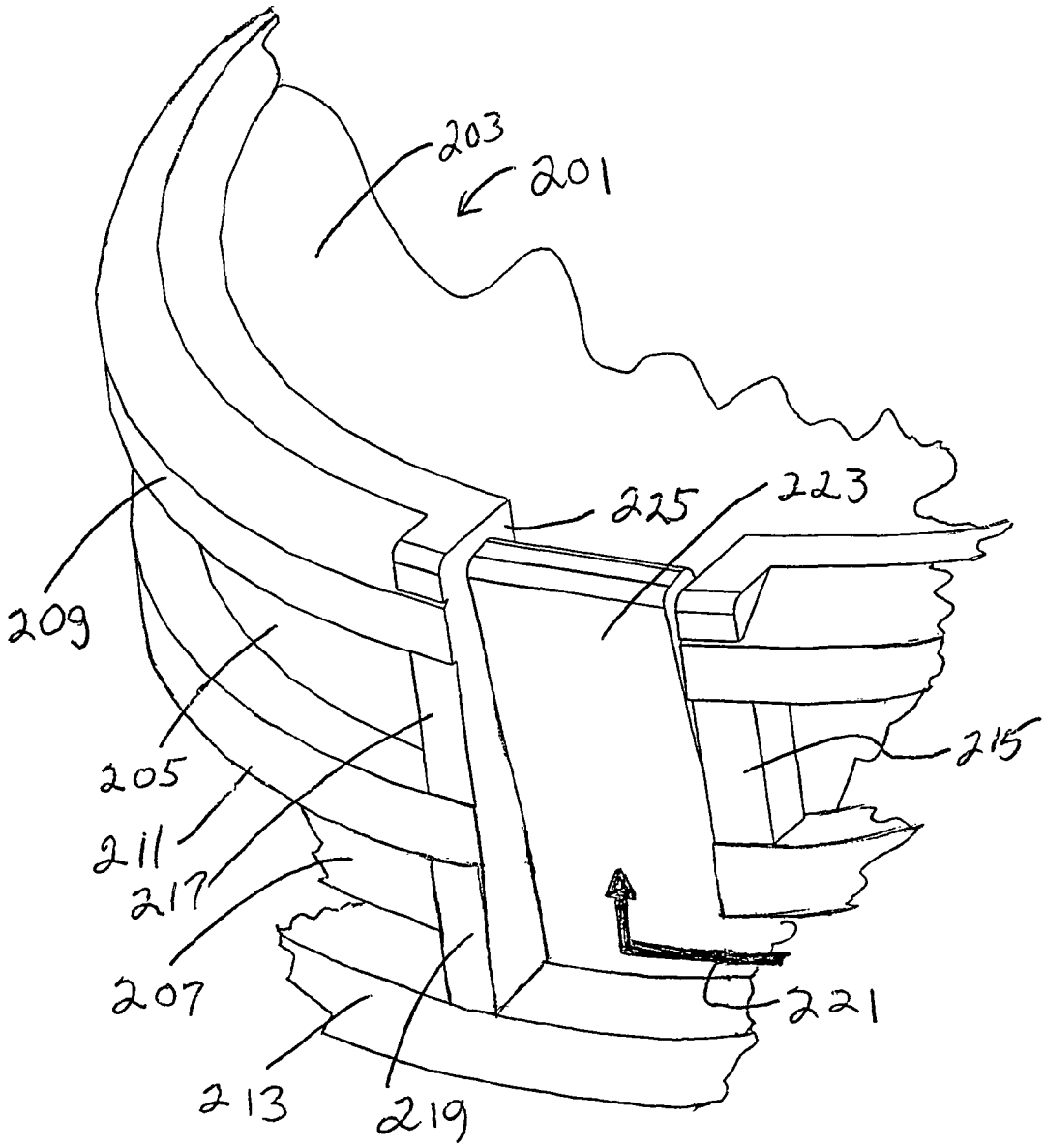

FIG. 16 shows a front oblique view of another embodiment of a present invention child resistant cap inner member 201. It has side wall 213 and top 203. There is a top horizontal flange 209, an upper track 205, a central horizontal flange 211 and a lower track 207. Upper track 205 has left stop 217 and right stop 215 at break 225, and lower track 207 has only single stop 219. This arrangement, discussed previously herein, prevents lug placement into break 225 when in upper track 205, and permits lug placement in break 225 when lugs are in lower track 207. In this preferred embodiment, the exit breaks have one way ratchet ramps, such as one way ratchet ramp 223 that permit upward lug movement but prohibit downward lug movement. With this arrangement, when an outer member is placed on an inner member it cannot inadvertently be placed in a firing position, i.e., it can only be pushed onto the upper track in non-firing (non-opening) positions. Arrow 221 shows a lug movement path in in last steps of opening (see FIGS. 10 and 11 above).

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims. For example, it is preferable for manufacturing and for ease of use to have breaks in the upper and lower tracks to be above one another (in alignment), yet the could be offset and the device could still effectively function, in which case, one or both of the upper track stops may be away from the actual adjacent break.

What is claimed is:

1. A child resistant cap with a U-channel safety component which comprises:

a) an inner member having a top and sidewalls and an open bottom, said sidewalls having two horizontal tracks, a first of said two horizontal tracks being an upper track, and a second of said horizontal tracks being a lower track, said upper track having a top horizontal flange with at least one break to permit movement of an outer member inwardly projecting lug therethrough, said upper track and said lower track being separated by a central horizontal flange with at least one break to permit movement of an outer member inwardly projecting lug from said lower track upwardly past said central horizontal break, past said upper track, and through said at least one break of said upper track top horizontal flange, said upper track having two vertical stops for one break of said at least one break of said upper track, said two vertical stops being one left of said break and one right of said break to prevent an outer member inwardly projecting lug from entering said break when in said upper track, said lower track having one stop adjacent one break, said at least one break of said lower track to permit an outer member inwardly projecting lug to enter said break when in said lower track;

b) an outer member, being a cover member, said outer member having a closed top and sidewalls and an open bottom, said sidewalls having a top view footprint so as to fit over said sidewalls of said inner member, and having at least one inwardly projecting lug adapted to snap over said top horizontal flange and subsequently snap over said central horizontal flange;

wherein said outer member is initially placed over said top horizontal flange and into said upper track of said inner member so that said at least one inwardly projecting lug is positioned in said upper track; and, wherein a subsequent user must first press down on said outer member to force said at least one inwardly projecting lug over said central horizontal flange and into said lower track of said inner member, and next horizontally rotate said outer member relative to said inner member until one of said at least one inwardly projecting lug is aligned with said upper track and lower track breaks, and next left said outer member so as to move said at least one inwardly projecting lug through said breaks to remove said outer member from said inner member.

2. The child resistant cap with a U-channel safety component of claim 1 wherein there are four lower track breaks, four upper track breaks and four inwardly projecting lugs.

3. The child resistant cap with a U-channel safety component of claim 2 wherein each of said four lower track breaks and said four upper track breaks and said four inwardly projecting lugs are symmetrically arranged and evenly spaced from one another.

4. The child resistant cap with a U-channel safety component of claim 2 wherein each of said four lower track breaks and said four upper track breaks and said four inwardly projecting lugs are asymmetrically arranged and unevenly spaced from one another.

5. The child resistant cap with a U-channel safety component of claim 1 wherein said at least one inwardly projecting lug is a downwardly tapered ratchet.

6. The child resistant cap with a U-channel safety component of claim 1 wherein said top horizontal flange and said central horizontal flange are downwardly yielding snap beads.

7. The child resistant cap with a U-channel safety component of claim 1 wherein said inner member includes attachment means for permanent connection to a container having a rim.

8. The child resistant cap with a U-channel safety component of claim 7, which further includes a container with a rim and with said inner member permanently attached thereto.

9. The child resistant cap with a U-channel safety component of claim 8 wherein said container is a spray container and said inner member has an orifice on its top for protrusion of a spray nozzle therethrough.

10. The child resistant cap with a U-channel safety component of claim 8 wherein said container includes a tilt dispensing nozzle and said inner member includes a tiltable shaft adapted to fit onto said tilt dispensing nozzle.

11. The child resistant cap with a U-channel safety component of claim 1 wherein said central horizontal flange is generally rigid and said at least one lug cannot traverse said central horizontal flange, and said central horizontal flange has at least one thin for each of said at least one lugs at which said at least one lug can traverse said central horizontal flange to move from said upper track to said lower track.

12. The child resistant cap with a U-channel safety component of claim 11 wherein said outer member and said inner member include indicia for alignment thereof to correspond to alignment of said at least one inwardly projecting lug with said central horizontal flange at least one thin.

13. The child resistant cap with a U-channel safety component of claim 11 wherein there are two lower track breaks and two upper track breaks and two inwardly projecting lugs.

14. The child resistant cap with a U-channel safety component of claim 11, which further includes a container with a rim and with said inner member permanently attached thereto.

15. The child resistant cap with a U-channel safety component of claim 11 wherein said container is a spray container and said inner member has an orifice on its top for protrusion of a spray nuzzle therethrough.

16. The child resistant cap with a U-channel safety component of claim 11 wherein said container includes a tilt dispensing nozzle and said inner member includes a tiltable shaft adapted to fit onto said tilt dispensing nozzle.

17. The child resistant cap with a U-channel safety component of claim 1 wherein said inwardly projecting lugs are identical.

18. The child resistant cap with a U-channel safety component of claim 1 wherein said inwardly projecting lugs are different and have different widths.

19. The child resistant cap with a U-channel safety component of claim 11 wherein said inwardly projecting lugs are identical.

20. The child resistant cap with a U-channel safety component of claim 11 wherein said inwardly projecting lugs are different and have different widths.

* * * * *